US005759342A

United States Patent [19]

Luhman et al.

[11] Patent Number: 5,759,342

[45] Date of Patent: Jun. 2, 1998

[54] HAND-HELD TAPE DISPENSER

[75] Inventors: Robert A. Luhman, New Richmond, Wis.; James D. Ramacier, Hugo; Craig D. Thompson, Inver Grove Heights, both of Minn.

[73] Assignee: Minnesota Mining and Manufacturing Company, St. Paul, Minn.

[21] Appl. No.: 731,067

[22] Filed: Oct. 9, 1996

[51] Int. Cl.[6] ..... B32B 35/00; B32B 31/00

[52] U.S. Cl. ..... 156/577; 156/579; 242/588; 242/588.2; 242/611; D19/67

[58] Field of Search ..... 156/494, 523, 156/527, 574, 577, 579; 225/77, 79; 242/588, 588.1, 588.2, 611; D19/67, 69

[56] References Cited

U.S. PATENT DOCUMENTS

| | | | |
|---|---|---|---|
| D. 361,086 | 8/1995 | Thompson et al. | D19/69 |
| D. 362,684 | 9/1995 | Samuelson et al. | D19/69 |
| 3,968,915 | 7/1976 | Schleicher | D19/69 X |
| 4,857,134 | 8/1989 | Lin | 156/579 X |
| 5,314,557 | 5/1994 | Schwartz et al. | 157/229 |
| 5,352,320 | 10/1994 | Schwartz et al. | 156/494 |
| 5,381,942 | 1/1995 | Lin | 156/577 X |
| 5,468,332 | 11/1995 | Dretzka et al. | 156/527 |
| 5,490,642 | 2/1996 | Schwartz et al. | 242/588 |
| 5,491,956 | 2/1996 | Donnelly et al. | 53/399 |
| 5,516,581 | 5/1996 | Kreckel et al. | 428/317.3 |
| 5,672,238 | 9/1997 | Samuelson | 156/579 |

OTHER PUBLICATIONS

"Scotch® Brand Box Sealer Tape Hand Dispensers," 3M Bulletin No. 34–7004–7321–7(63.5)R1, published prior to Oct. 9, 1996.

"Scotch® Brand H–129 Box Sealer," *Instructions and Parts List*, 3M Bulletin No. 34–7004–7253–2(F14.5)R1, dated 1994.

"Scotch® Brand Stretchable Tape — #8884," *Technical Information*, dated 1994.

"Scotch® Brand Stretchable Tape —# 8886," *Technical Information*, dated 1994.

"Scotch® Brand H–192 Box Sealing Tape Dispenser," 3M Bulletin No. 70–0705–0846–3(1031.5)BE, published prior to Oct. 9, 1996.

*Primary Examiner*—Curtis Mayes
*Attorney, Agent, or Firm*—Charles D. Levine

[57] ABSTRACT

A hand-held tape dispenser has a tape support hub and a support frame. A brake assembly is pivotally mounted on the frame, and has a curved brake actuator and flat brake plate. The brake plate is aligned to engage a tape roll mounted on the tape support hub and inhibit its free rotation (and dispensing) according to an operator's selection of applied pressure. The brake plate bends about the tape roll as pressure is increased to facilitate tape cutting or tape stretching (in the case of stretchable tape in the dispenser).

21 Claims, 9 Drawing Sheets

HAND-HELD TAPE DISPENSER

BACKGROUND OF THE INVENTION

This invention relates to a tape dispensing device, and more specifically, to a manual, portable dispensing apparatus which is particularly adaptable for use with a roll of stretchable adhesive tape.

Many manufacturing and distribution settings require that products or packages be grouped together to facilitate the handling, loading, shipping and storage of those items. Such grouping is commonly known as "unitizing." There are several ways to unitize products. Palletization is one unitizing method, which involves placing a number of boxed items on a pallet in a cube or other rectangular array. The array of boxed items is then strapped or wrapped to the pallet to insure the lateral stability of the array during shipping and loading of the pallet. Bundling is another unitizing method, which involves strapping or wrapping a number of products together. There are numerous other unitizing methods which also require the use of either a strapping or wrapping material to secure otherwise discrete items together for handling, shipping or storage.

An adhesive tape has been developed to provide an efficient way to strap products and packages together. A description of this adhesive tape is provided in assignee's co-pending U.S. Pat. No. 5,516,581, granted May 14, 1996, which is a continuation of assignee's abandoned U.S. application Ser. No. 07/802,061, filed Dec. 10, 1992, which is a continuation-in-part of assignee's abandoned U.S. application Ser. No. 07/632,173, filed Dec. 20, 1990; assignee's U.S. Pat. No. 5,314,557, granted May 24, 1994; and assignee's U.S. Pat. No. 5,491,956, granted Feb. 20, 1996, which is a continuation of assignee's abandoned U.S. application Ser. No. 07/892,220, filed June 2, 1992, all of which are fully incorporated herein by reference. This adhesive tape is stretchable and is comprised of a highly extensible, substantially nonrecoverable backing which has a layer of pressure sensitive adhesive on at least one of its surfaces. The pressure sensitive adhesive has sufficient shear strength and adhesive holding power to adhere to small regions of the objects to which the unstretched tape is attached. This adhesive property of the tape, however, is greatly reduced when the tape is stretched or elongated to several times its original length (e.g., stretched 600 to 800 percent). Essentially, the adhesive on the tape becomes "detackified" when the tape is elongated. This detackification is beneficial because it greatly reduces the damage that the adhesive could cause to an object surrounded by the tape when the tape is removed from that object.

The elongation of the tape provides other important benefits beyond inducing detackification. First, the tensile strength of the tape increases when the tape is elongated. Accordingly, the tape can be used in strapping methods which require a high tensile strength strap. Secondly, the elongation of the tape reduces the quantity of tape that is needed for a given unitizing application, thereby reducing the cost of each application. Further, the amount of material which must be recycled or disposed of in a landfill is consequently reduced, compared to unitizing or wrapping with film.

Stretchable adhesive tapes of this type are available from Minnesota Mining and Manufacturing Company, St. Paul, Minn., and can be identified as SCOTCH™ Brand Stretchable Tape, Model Nos. 8884 and 8886. Rolls of such tape are available in commonly employed sizes, such as 3-inch core diameter rolls, 1.5-inch and 3-inch widths, and 55 meter to 500 meter lengths.

Such stretchable adhesive tape has proven to be useful in a variety of unitizing procedures. For example, the tape can be used to strap an array of objects together on a pallet. To do so, an unstretched tackified portion of the tape is applied to a first object in the array. Once secured, the tape is stretched to induce detackification and wrapped around the remaining objects. Finally, a portion of the unstretched tape is adhered to an object in the array to anchor the stretched detackified tape. As applied above, the tape provides stability to the wrapped objects during shipping, handling and storage of the pallet. The tape can easily be removed from the pallet when a shipped pallet reaches its destination by merely releasing the adhering portions of the tape from the objects. A more detailed description of a palletization method such as this is set forth in assignee's above-referenced U.S. Pat. No. 5,314,557.

Both automatic and manual applicators for stretchable adhesive tape having been developed. An automatic machine that utilizes stretchable adhesive tape to palletize objects is disclosed in assignee's U.S. Pat. No. 5,491,956. This machine has a rotating turntable upon which an array of objects is stacked. A taping head located adjacent the turntable is moved vertically with respect to the stacked array of objects. The taping head advances tape through a stretch station and feeds the tape to the array of objects as the turntable is rotated. The operation of this machine is managed by a programmable controller, which simultaneously controls the tape dispensing and amount of stretch performed by the taping head, the vertical movement of the taping head and rotation of the turntable.

A manual tape dispensing device is disclosed in assignee's U.S. Pat. No. 5,352,320, issued Oct. 4, 1994, which is fully incorporated by reference herein. This device has a spool for carrying a roll of tape and a handle connected to the spool for manually grasping and manipulating the device. The mechanism for stretching the tape is arranged to receive the tape from its roll, and has a stretching zone defined between first and second engagement surfaces where the tape is frictionally engaged. The first and second engagement surfaces move at disparate longitudinal speeds to stretch the tape when the stretching mechanism is activated. A manually operative mechanism is provided for selectively activating the stretching mechanism so an operator can remove the tape from the roll in a substantially detackified stretched condition when the stretching mechanism is activated. The manually operative mechanism also permits the operator to remove the tape from the supply in an unstretched condition.

Another manual tape dispensing apparatus is disclosed in assignee's U.S. Pat. No. 5,490,642, which is incorporated by reference herein. This apparatus has a hub for supporting a roll of stretchable adhesive tape, with the hub configured to be manually gripped by an operator. A stretching surface is connected to the hub so that the operator may selectively orient the dispensing apparatus in either a stretching position or an unstretching position. The stretching surface contacts a portion of the tape when the apparatus is in the stretching position such that the operator can dispense the tape in a stretched detackified condition. When the operator orients the dispensing apparatus in an unstretched position, tape can be dispensed in an unstretched tackified condition.

SUMMARY OF THE INVENTION

The present invention is a hand-held tape dispensing apparatus for dispensing and applying adhesive tape. The apparatus has a frame including a hub for rotatably supporting a roll of adhesive tape. The apparatus also has a brake assembly which includes a brake cover extending around a portion of the roll of tape. The brake actuator has a first end supported relative to the frame so that a second end thereof is movable towards and away from the roll of tape. The brake assembly has a brake plate disposed between the brake actuator and the roll of tape for engagement with an outermost wrap of the roll of tape upon movement of the second end of the brake actuator towards the roll of tape.

In a preferred embodiment, the hub and brake actuator are formed to define a handle for the tape dispensing apparatus. Preferably, the brake assembly has two operative positions: (1) a first position wherein the brake actuator is spaced from the roll of tape and the brake plate is generally planar with a first area of contact between the roll of tape and the brake plate, and (2) a second position wherein the brake actuator is urged closer to the roll of tape and at least a portion of the brake plate is bent about the roll of tape with a second, increased area of contact between the roll of tape and the brake plate.

The hand-held tape dispensing apparatus of the present invention provides a means for applying adhesive tape in a number of applications, including specifically the application of stretchable adhesive tape. In a preferred embodiment, the adhesive tape is stretchable, and when its leading end has been adhered to a workpiece, the second end of the brake actuator is movable to a position adjacent the roll of tape whereby the brake plate inhibits rotation of the roll of tape relative to the frame so that movement of the tape dispensing apparatus away from the workpiece stretches the tape between the workpiece and apparatus. The brake assembly thus provides a means for controlled tension application to the tape being dispensed, and for stretching the tape between the apparatus and the workpiece for elongation and detackification thereof.

The inventive apparatus is portable and sufficiently small to enable an operator to easily manipulate the apparatus and tape dispensed thereby using the operator's hands. The application of the brake assembly to limit rotation of the roll of tape is performed simply by squeezing the apparatus, and the force required is lessened by the leveraged design of the brake assembly. The apparatus provides a manually operative mechanism for limiting rotation of the roll of tape relative to the apparatus, thereby providing the means for controlling the tape characteristics of resiliency, tensile strength and detackification (for stretchable tape). It is also useful to limit rotation and dispensing of the tape relative to the apparatus when cutting off the tape dispensed therefrom.

BRIEF DESCRIPTION OF THE DRAWINGS

The present invention will be further explained with reference to the figures listed below wherein like structure is referred to by like numerals throughout the several views.

While the above-identified figure features set forth several preferred embodiments, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Overview

Figure 1:
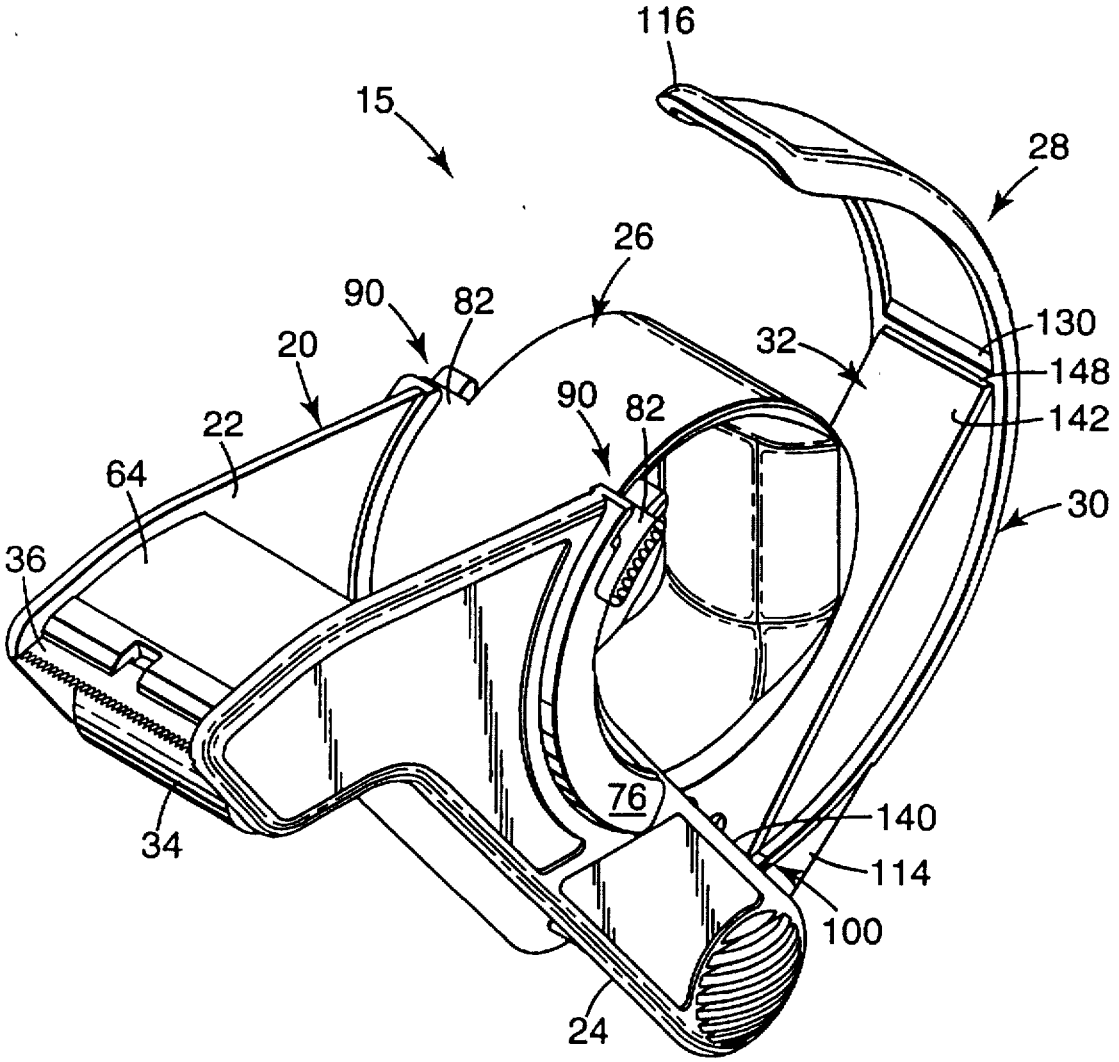
FIG. 1 is an isometric view of the portable, hand-held tape dispensing apparatus of the present invention.
Figure 2:
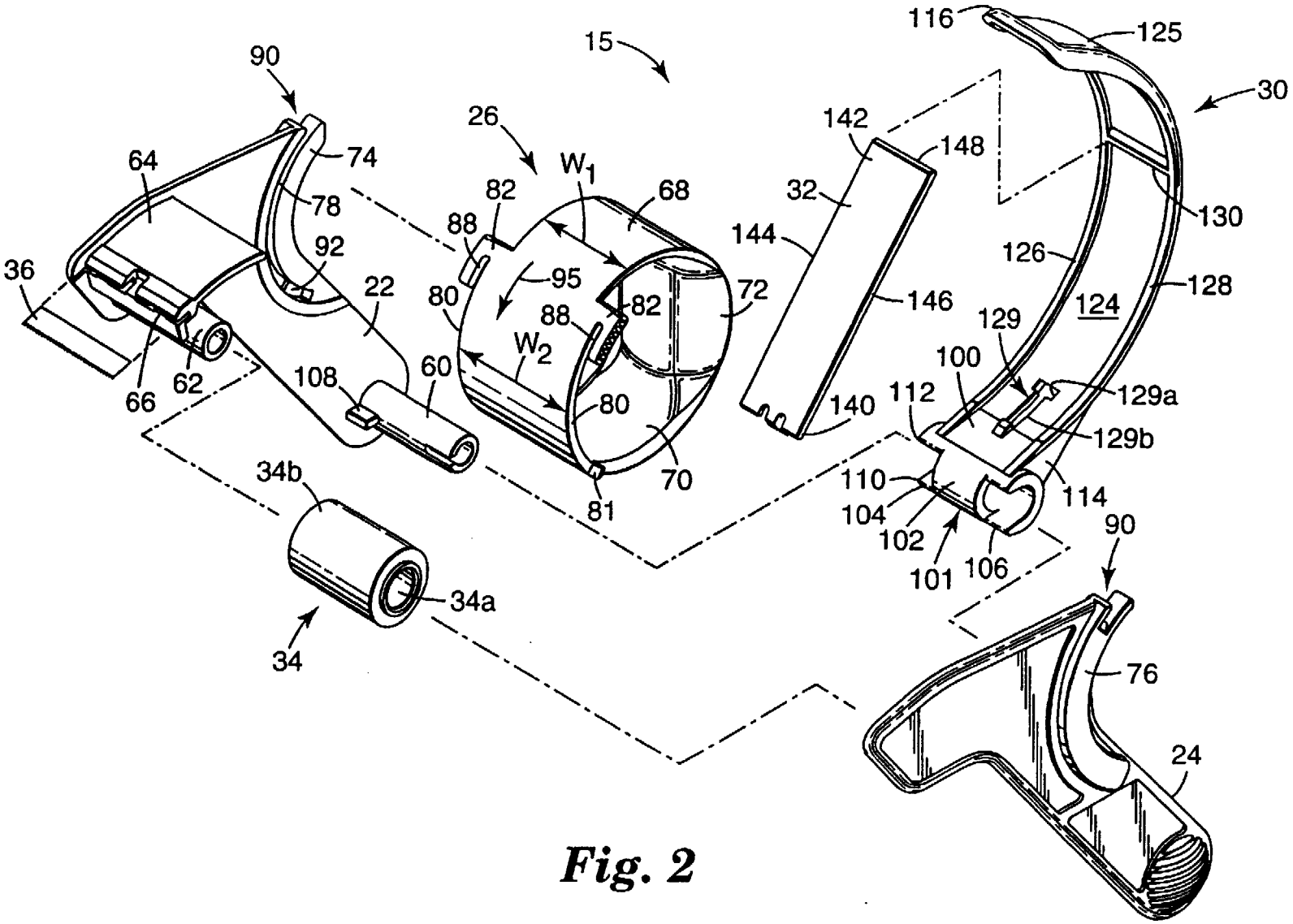
FIG. 2 is an exploded isometric view of the apparatus of FIG. 1.

A portable hand-held tape dispenser 15 embodying the present invention is illustrated in FIG. 1, and an exploded view of the components of the dispenser 15 is seen in FIG. 2. For clarity of illustration, the dispenser 15 of FIGS. 1 and 2 is shown without a roll of tape. The dispenser 15 includes a crane 20 having opposed frame members 22 and 24. A tape hub 26 is removably mounted on the frame 20. A brake assembly 28 is movably mounted relative to the frame 20 and tape hub 26 thereon. The brake assembly 28 includes a brake actuator or cover 30, which is pivotally mounted relative to the frame 20, and a brake plate 32 carried on the brake actuator 30. A tape guide roller 34 and tape cutting knife 36 may also be mounted on the frame 20.

Figure 3:
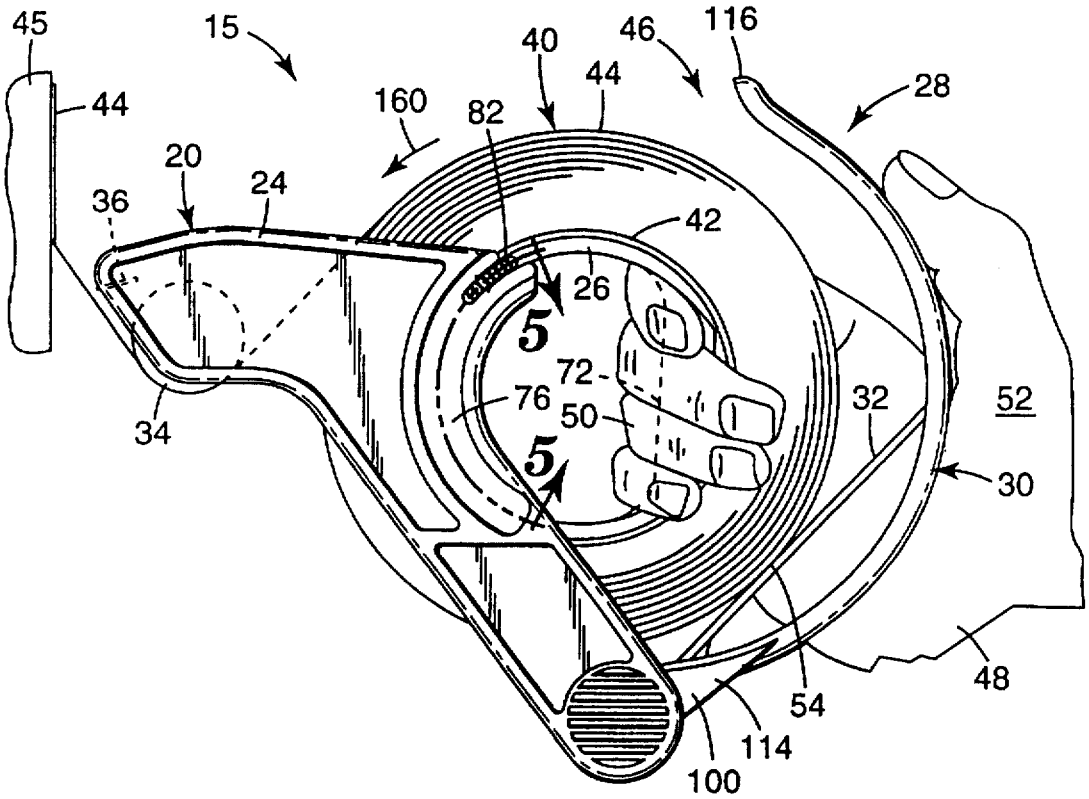
FIG. 3 is a side elevational view of the apparatus of FIG. 1, with the brake assembly in its first open condition, which allows free dispensing of tape therefrom.

FIG. 3 illustrates the dispenser 15 with a tape roll 40 borne thereby. Such a tape roll 40 has a central annular opening, which may or may not be defined by a supporting core 42 (i.e., the tape roll 40 may be wound on a separate central core or it may be wound as a "coreless" tape roll). As supplied for use, a desired length or strip of tape 44 is spirally wound into a tape roll 40 having a desired tape roll diameter. As illustrated in FIG. 3, the tape roll 40 is supported by tape hub 26, and the guide roller 34 serves in part to define a tape dispensing path from the tape roll 40 to a workpiece 45 (which may be a single item or an array of items). The inner diameter of the tape roll 40 is slightly larger than the outer diameter of the tape hub 26, allowing the tape roll 40 to rotate freely about the tape hub 26 for dispensing tape 44 from the dispenser 15.

Figure 4:
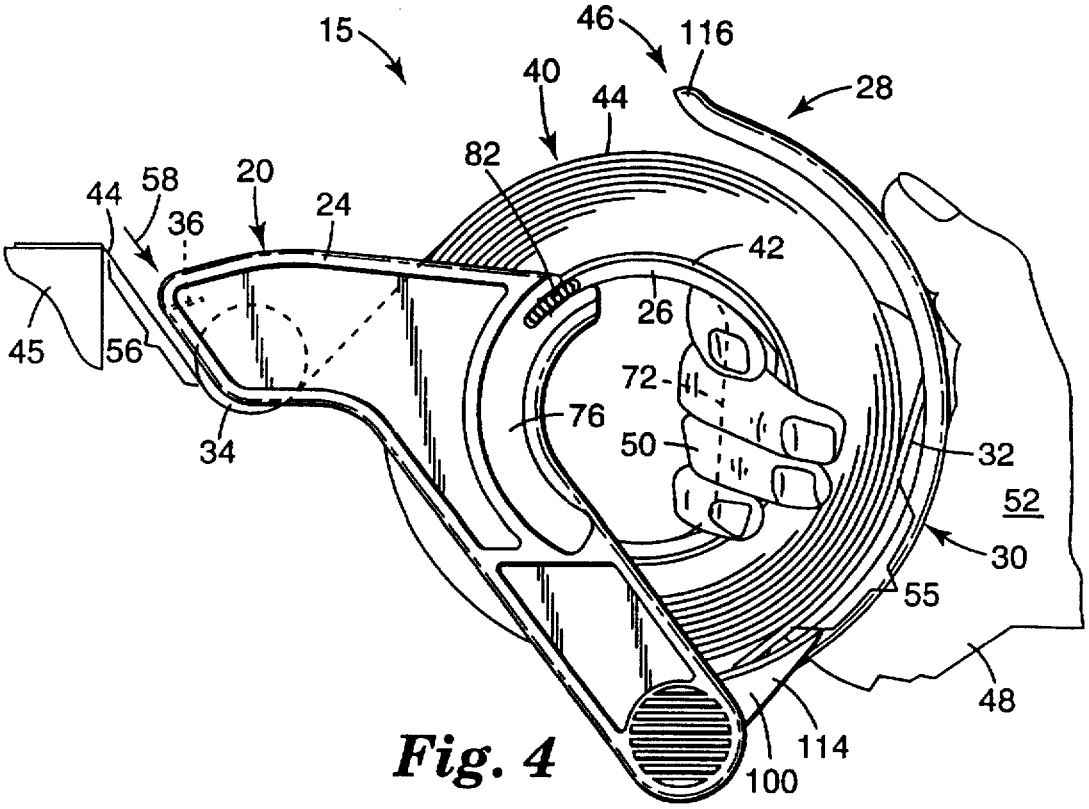
FIG. 4 is a side elevational view of the apparatus of FIG. 1, with the brake in its second closed position, which inhibits rotation of the roll of tape relative to the apparatus.

As illustrated in FIGS. 3 and 4, the tape hub 26 and brake assembly 28 together define a handle assembly 46 for the dispenser 15. Using a single hand 48, an operator can hold and manipulate the dispenser 15 by inserting his or her fingers 50 within the tape hub 26 and placing a portion of the palm and thumb area 52 against an outer surface of the brake actuator 30 of the brake assembly 28.

FIG. 3 shows an operator holding the dispenser 15 for freely dispensing tape 44 onto the workpiece 45. While the brake plate 32 may contact the outer diameter of the tape roll 40 (as at 54), this contact does not significantly inhibit free rotation of the tape roll 40 relative to the dispenser 15. In FIG. 4, the operator's hand 48 is squeezed to urge the brake actuator 30 closer to the tape hub 26, thereby forcing the brake plate 32 against the outer diameter of the tape roll 40. There is a resultant greater contact area between the brake plate 32 and the outer diameter of the tape roll 40 (as at 55), and this, along with the increased pressure therebetween, frictionally limits the rotation of the tape roll 40 relative to the dispenser 15. Thus, the dispensing of tape therefrom is inhibited, and if the operator's hand is squeezed hard enough, the dispensing of tape is stopped altogether.

In the preferred embodiment, the tape 44 is tape which is stretchable along its length. Suitable stretchable adhesive tapes of this type are available from Minnesota Mining and Manufacturing Company, St. Paul, Minn., and are identified as SCOTCH™ brand stretchable tapes, Model Nos. 8884 and 8886. When the handle assembly 46 of the dispenser 15 is placed in its closed position (FIG. 4), that portion of tape 44 disposed between the dispenser 15 and workpiece 45 (designated in FIG. 4 as tape portion 56) can be stretched by moving the dispenser 15 away from the workpiece 45 (as in direction of arrow 58 in FIG. 4). The brake assembly 28 limits further dispensing of the tape 44, thereby causing the tape portion 56 to stretch as the dispenser 15 is pulled away from the workpiece 45. Also, when the handle assembly 46 is placed in its closed position (FIG. 4), the tape portion 56 disposed between the workpiece 45 and dispenser 15 can be held taut for severing by the cutting knife 36 on the dispenser 15.

While this disclosure focuses on the present invention and its utility with respect to stretchable tape, other types of tape can be dispensed by the dispenser 15. In the context of this disclosure, tape means a flexible sheet which is provided in roll form, and more preferably, a flexible sheet having an adhesive on at least a portion of at least one side thereof which is provided in roll form.

Frame

As best seen in FIG. 2, the frame members 22 and 24 are similar in overall shape. Frame member 22 is aligned with and secured to frame member 24 by means of brake assembly pivot shaft 60, roller shaft 62 and knife support plate 64. The frame members 22 and 24 are secured together by suitable means, such as by ultrasonic welding or conventional fasteners (not shown) extending through shafts 60 and 62, and the interengagement of opposed portions thereof. When so assembled, the tape guide roller 34 is aligned on roller shaft 62 between frame members 22 and 24, and is freely rotatable thereon. The knife support plate 64 shields portions of the tape dispensing path through the dispenser 15, including those portions adjacent the tape guide roller 34. The knife support plate 64 has a slot 66 adapted to receive and retain tape cutting knife 36 in position for use in cutting the tape 44 dispensed from the dispenser 15.

In a preferred embodiment, the frame members 22 and 24 are formed from a polymer, such as, for example, ABS high impact Diamond polymer #3501 or Toray Toyolac #100. In addition, in a preferred embodiment, the roller 34 is formed as a central bearing hub **34*a* covered by a roller surface 34*b*. Preferably, the hub 34*a* is formed from acetal (e.g., Delrin 100) and the roller surface 34*b*** is formed from a thermoplastic elastomer rubber (e.g., Santoprene grade 101–55).

Tape Hub

The tape hub 26 is separable from the frame 20 to permit the loading of a new tape roll 40, or the removal of a core 42 from a spent tape roll 40. The tape hub 26 has an annular outer surface 68. Its inner surface 70 is generally annular, although it is contoured along portion 72 to facilitate gripping and manipulation by an operator when the dispenser 15 is in use.

Figure 5:
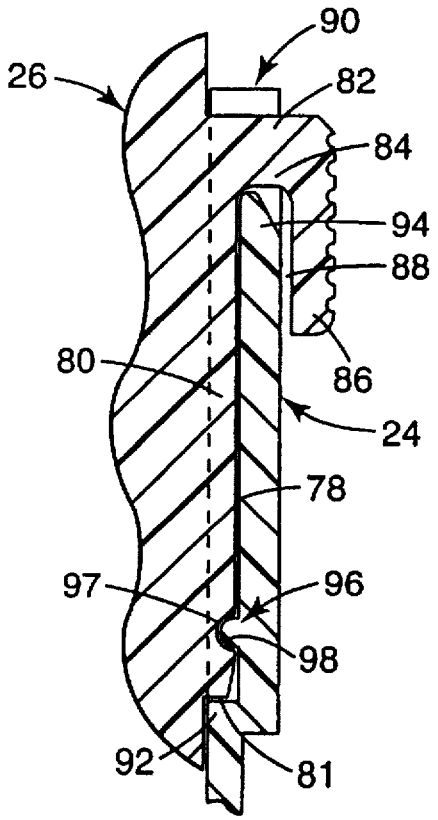
FIG. 5 is a partial sectional view as taken along lines 5—5 in FIG. 3.

The tape hub 26 is mounted on the frame 20 by means of a pair of opposed tracks 74 and 76 on the frame members 22 and 24, respectively. Each track has an arcuate shaped slot 78 (see slot 78 in FIG. 2) in its respective frame member. Over most of its circumference, the tape hub 26 has a width $w_1$. However, one arcuate segment of the tape hub 26 has an enlarged width $w_2$ and is adapted to interengage with the arcuate shaped slots 78. A flange 80 extends from each side of the tape hub 26 to in part define its enlarged width $w_2$. At one end, each flange 80 has a leading edge 81, while at its other, trailing edge, each flange has an outstanding ear portion 82. Each ear portion 82 (as best seen in FIGS. 2 and 5), continues to define outer surface 68 of the tape hub 26 (as do the flanges 80), with a further width extension 84 and a finger 86 extending circumferentially from the end thereof. A slot 88 is thus defined adjacent the trailing edge of each flange 80 by a portion of the flange 80 itself, extension 84 and finger 86.

Each slot 78 in the frame member has an open end 90 and a closed end 92 (see FIG. 2). Adjacent its open end 90, the slot is further in part defined by an outer end portion 94 (as seen in FIG. 5).

The tape hub 26 is mounted in the frame 20 by aligning the leading edges 81 of the flanges 80 with the open ends 90 of the slot 78. The tape hub 26 is then rotated about its axis (in direction of arrow 95 in FIG. 2) to slide the flanges 80 into the slots 78, with rotation continuing until the leading edges 81 abut the closed ends 92 of the slots 78 (as in FIG. 5). At the same time, the outer end portion 94 is received within its associated slot 88 adjacent the ear portion 82 of each flange 80. When so assembled, the tape hub 26 and frame 20 are aligned as seen in FIGS. 1, 3 and 4. The tape hub 26 is further coupled to the frame 20 by a detent connection 96 (see FIG. 5). Each flange 80 has a groove 97 therein, which mates with an opposed ridge 98 in each slot 78 when the tape hub 26 has been fully rotated and seated into position on the frame 20.

In a preferred embodiment, the tape hub 26 is formed from a polymer, such as, for example, ABS high impact Diamond polymer #3501 or Toray Toyolac #100.

Brake Assembly

The brake actuator 30 is curved to extend about a portion of the tape roll 40 in the dispenser 15. At a first end 100 thereof, the brake actuator 30 has a journal section 101 adapted to be pivotally received about the brake pivot shaft 60 on the frame 20. The journal section 101 is generally tubular, with a central section 102, and opposed end sections 104 and 106. The sections 102, 104 and 106 are cut away to define opposed C-shaped segments (see, e.g., FIGS. 2 and 6). A pair of pivot limit tabs 108 are carried on the frame 20 adjacent the brake pivot shaft 60 (in FIGS. 2 and 6, only the tab 108 on frame member 22 is shown). Each tab 108 extends through the open portion of its respective C-shaped end section 104 and 106. Free ends 110 and 112 of the end sections thus engage the pivot limit tab 108 to establish the extent of pivoting of the brake actuator 30 relative to the frame 20. Brake actuator 30 is preferably formed with one or more support flanges 114 to strengthen and secure the journal section 101 relative to the brake actuator 30. At its second free end 116, the brake actuator 30 is flared radially outwardly to provide a tactile indicator for a user of the end of the brake actuator 30, and also to facilitate the loading and unloading of tape rolls onto the dispenser 15.

Figure 6A:
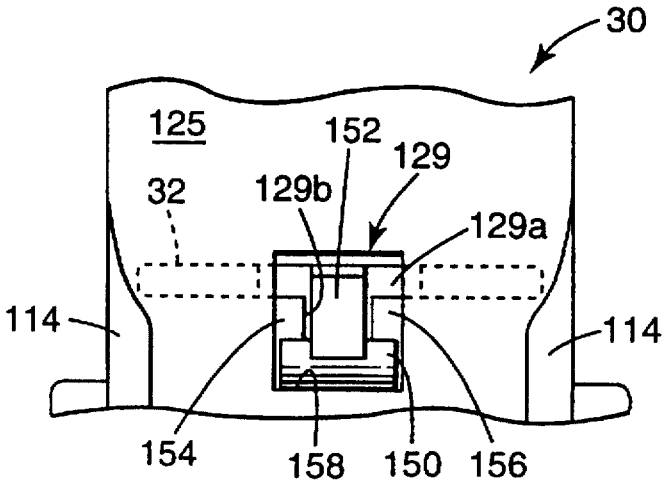
FIG. 6A is a partial plan view as taken along lines 6A—6A in FIG. 6.
Figure 6:
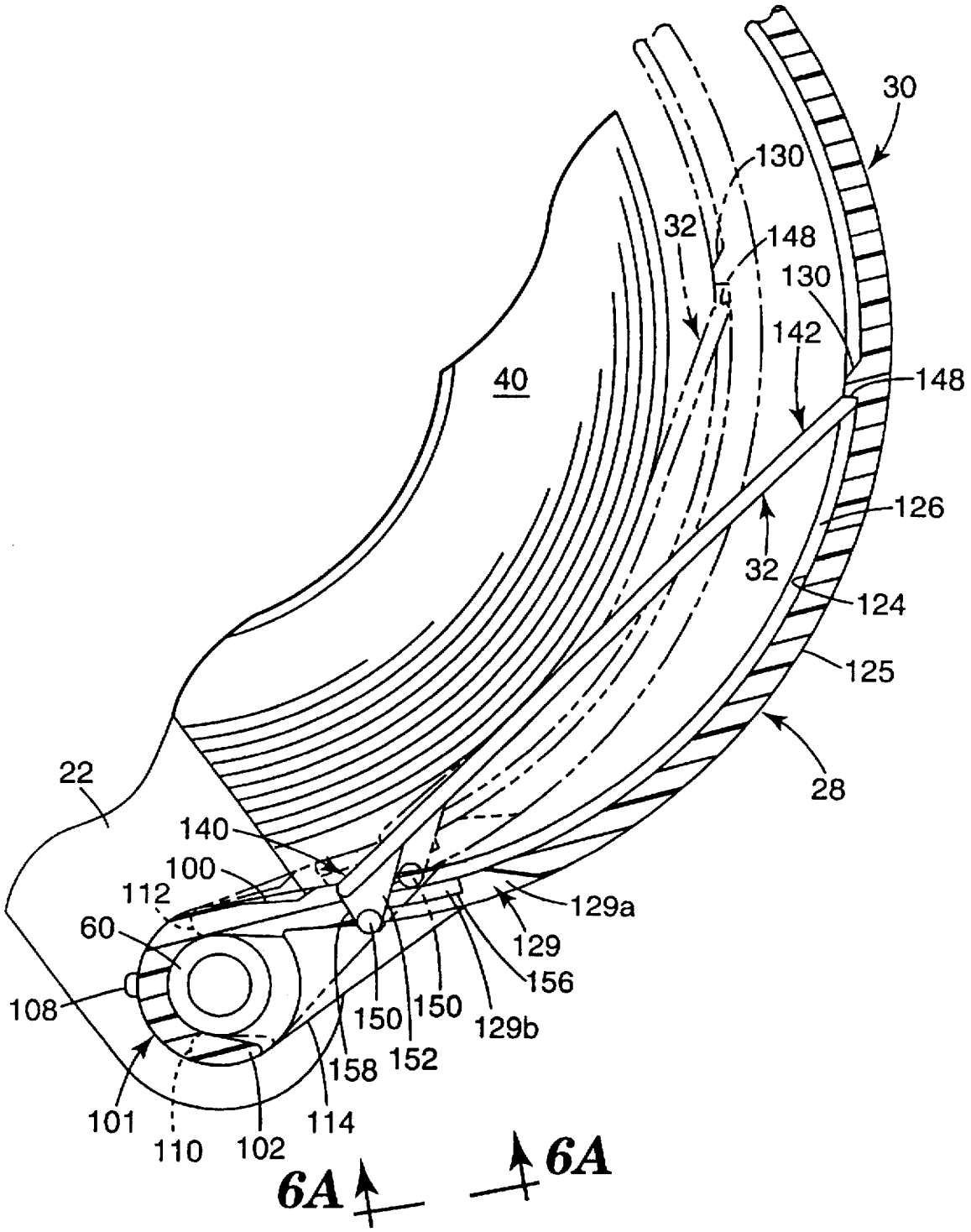
FIG. 6 is a partial sectional view along a radial plane (relative to the axis of a roll of tape in the dispensing apparatus) through the center of the brake assembly.

The brake actuator 30 has an inner surface 124 (FIG. 2) and an outer surface 125 (FIG. 6), and as seen in FIG. 2, the inner surface 124 of the brake actuator 30 is generally arcuate and has edge rails 126 and 128 extending therealong. A cross rail 130 extends across the side rails 126 and 128, generally adjacent a central portion of the inner surface 124 of the brake actuator 30. Adjacent its first end 100, the brake actuator 30 has a centrally aligned T-shaped slot 129 therethrough. The slot 129 and inner surface 124 are formed to mate with the brake plate 32, as illustrated in FIG. 6, which is carried by the brake actuator 30.

The brake plate 32 is generally rectangular and planar in a relaxed condition, with a first end 140 and a second end 142. Along its length, the brake plate 32 has opposed parallel side edges 144 and 146 extending between its first and second ends 140 and 142. The second end 142 is more specifically defined by a linear end edge 148.

A lateral pivot pin 150 is mounted adjacent the first end 140 of the brake plate 32 by a central support 152. As seen in FIG. 6A, the width of pin 150 is slightly smaller than the width of a larger (top) portion **129*a* of the T-shaped slot 129, thereby allowing its insertion into the slot 129. The width of the central support 152 is slightly smaller than the width of a narrower (bottom) portion 129*b* of the T-shaped slot, thereby allowing it to be slidably received therein. The outer surface 125 of the brake actuator 30 is recessed on each side of the narrower portion 129*b* of the slot 129 to define slide shoulders 154 and 156, and slot base surface 158 (see FIGS. 6 and 6A). Once inserted within the slot 129, the pivot pin 150 can slide therein (on slide shoulders 154 and 156) and under the narrower portion 129*b* of the slot 129, and serves to retain the brake plate 32 in an operative position relative to the brake actuator 30. As seen in FIG. 6, when the brake plate 32 is mounted to the brake actuator 30, it extends such that its end edge 148 abuts the cross rail 130 on the inner surface 124 of the brake actuator 30 and its pivot pin 150 abuts the slot base surface 158**.

In a preferred embodiment, the brake actuator or cover 30 is formed from a polymer, such as, for example, ABS high impact Diamond polymer #3501 or Toray Toyolac #100, and the brake plate 32 is formed from a resilient material such as, for example, Hytrel #8238.

FIG. 6 shows the brake assembly 28 in its relaxed, open position for tape dispensing (in solid lines) from tape roll 40. The relative positions of the brake plate 32, brake actuator 30 and tape roll 40 are shown in phantom lines when the brake assembly 28 is placed in its closed position to stop dispensing of tape and permit tape stretching and/or cutting. As seen, the brake plate 32 bends as it is urged against the outer circumference of the tape roll 40. Both the first end 140 and second end 142 of the brake plate 32 move away from their abutment surfaces (base surface 158 of the slot 129 and cross rail 130, respectively). In this latter condition, a greater portion of the brake plate 32 (adjacent its midpoint) contacts the tape roll 40 as it bends around the circumference thereof, thereby providing a greater frictional engagement area therebetween. As the second end 142 of the brake plate 32 moves relative to the brake actuator 30, side rails 126 and 128 on the brake actuator 30 retain and guide side edges 144 and 146, respectively, of the brake plate 32.

Operation

In use, a tape roll 40 is first loaded into the dispenser 15. An empty dispenser 15 has its brake assembly 28 pivoted away from the tape hub 26 thereon. The tape hub 26 is then rotated to separate the ear portions 82 from the tracks 74 and 76. After sufficient rotation, tape hub 26 can be freely removed from the frame 20, a tape roll 40 axially inserted thereover, and the process reversed to secure tape hub 26 and tape roll 40 thereon onto the frame 20. The brake assembly 28 is then pivoted toward the tape roll 40 and held in position as shown in FIG. 3 for use. The free end of the tape 44 is advanced along the tape path about the roller 34 and adjacent the cutting knife 36. The free end is then applied to a workpiece 45, as seen in FIG. 3, and tape dispensed by moving the dispenser 15 relative to the workpiece 45 (or vice versa). The tape roll 40 is freely rotatable about the tape hub 26 in the direction of arrow 160 (FIG. 3). The operator uses the handle assembly 46 defined by tape hub 26 and brake assembly 28 to hold the dispenser 15 in the dispensing condition seen in FIG. 3, but does not squeeze the components together to exert a braking force on the tape. In this state, the brake plate 32 does make contact with the outer circumference of the tape roll 40, but no pressure is applied by the operator so that the contact is minimal and does not significantly impede the dispensing of tape by the operator.

If tension is required for dispensing, cutting or for stretching (in the case of stretch tape), the operator squeezes his or her hand to a position as shown in FIG. 4, thereby moving the brake assembly 28 to a closed position. In this state, the brake actuator 30 and brake plate 32 are urged toward tape hub 26. The brake plate 32 bends about the tape roll 40 and with pressure engages the tape roll 40 at a larger contact area than previously. In so doing, ends 140 and 142 of the brake plate 32 slide toward each other (to the phantom position as illustrated in FIG. 6). The dispensing of tape can merely be slowed by exerting partial pressure or the dispensing of tape can be completely stopped by exerting full pressure.

For stretch tape, a full pressure application of the brake assembly 28 will allow stretching of the tape 44 by pulling the dispenser 15 away from the workpiece 45 (in direction of arrow 58 in FIG. 4). In the case of stretchable adhesive tape, the stretching of the tape detackifies the tape (reduces its adhesion qualities). Thus, the stretched tape does not adhere as well to the workpiece (or may be designed to be used as a handle for the workpiece). In some situations, after a portion of the tape 44 has been stretched (such as portion 56 in FIG. 4), the brake assembly 28 is released to allow dispensing of an additional unstretched portion of the tape 44. By allowing another portion of the tape 44 to be dispensed without stretching, it is not detackified and thus can serve to tack down the tape once cut.

After a desired length of tape 44 has been dispensed, the brake assembly 28 is applied to place tension on the tape portion 56 extending between the workpiece 45 and dispenser 15 and allow severing thereof, using the tape cutting knife 36. This is accomplished merely by rotating the dispenser 15 to contact the knife 36 with the taut tape extending from the workpiece 45.

The brake assembly 28 operates extremely efficiently and simply to apply controlled tension and braking to the tape 44 dispensed by the dispenser 15. The use of the brake plate 32 and its design effectively shortens the lever arm for the brake about its pivot point relative to the frame 20. By doing so, less force is required by the operator to attain higher frictional interengagement between the brake assembly 28 and tape roll 40. Thus, the operator is less fatigued in using the dispenser 15 because less squeezing force is required to stop the dispensing for stretching or for cutting of the tape. The dispenser's ergonomic and efficient design thus facilitates simple and efficient tape loading and unloading, and use of the dispenser itself in applying, stretching and cutting the tape.

Alterative Embodiments

Figure 7:
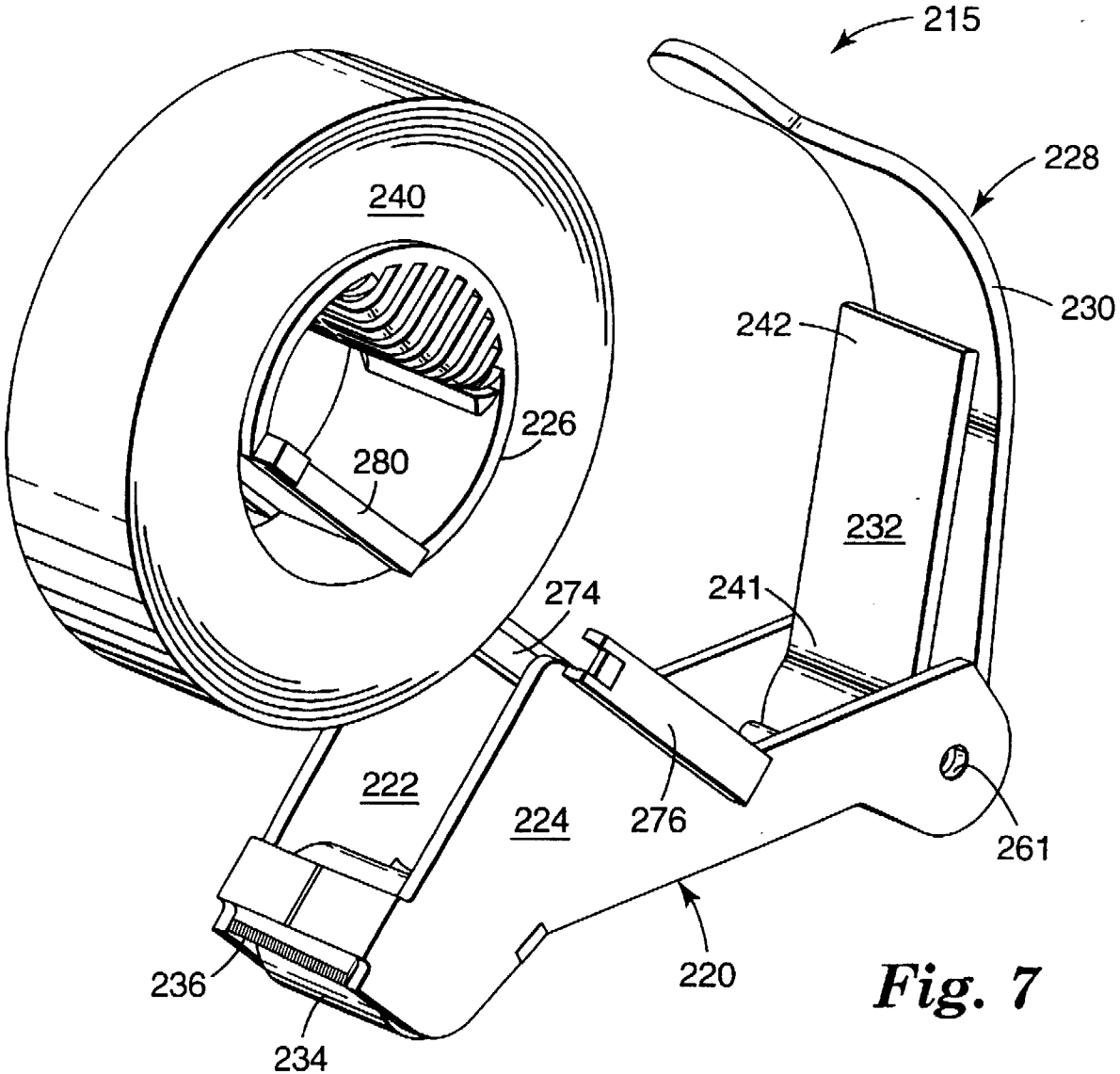
FIG. 7 is an isometric view of an alternative embodiment of the hand-held tape dispensing apparatus of the present invention.

Alternative dispenser constructions are, of course, possible to achieve the controlled tension and braking scheme of the present invention. Several alternative structures suitable for these purposes are shown in FIGS. 7–10. In FIG. 7, a two-part dispenser 215 is disclosed having a frame 220 and tape hub 226. Again, tape hub 226 is separable from the frame 220. In this embodiment, the tape hub 226 and frame 220 are again secured together by means of opposed pairs of tracks 274 and 276 and rails 280, but the tracks and rails are linear instead of arc shaped. The tracks and rails are aligned to be run normal to the pressure forces applied by the brake assembly 228 to the roll of tape 240.

Like the initial embodiment disclosed, the dispenser of this embodiment includes opposed frame members 222 and 224, with a tape guide roller 234 and tape cutting knife 236 disposed therebetween. The brake assembly 228 likewise has a brake actuator or cover 230 and a brake plate 232. In this case, the brake actuator 230 and brake plate 232 are integrally formed (this feature is more clearly shown in the embodiment of FIGS. 8 and 9). Thus, a first end 241 of the brake plate 232 is connected to the brake actuator 230, while a second end 242 of the brake plate 232 is free from connection thereto. This unitary brake assembly 228 is pivotally mounted to the frame 220, along a pivot axis 261. The use of a brake plate 232 of this design still serves to shorten the lever arm between the pivotal attachment for the brake assembly and the contact point between the brake assembly 228 and the roll of tape 240, thereby simplifying its use and improving its effect on operator performance and handling.

Figure 8:
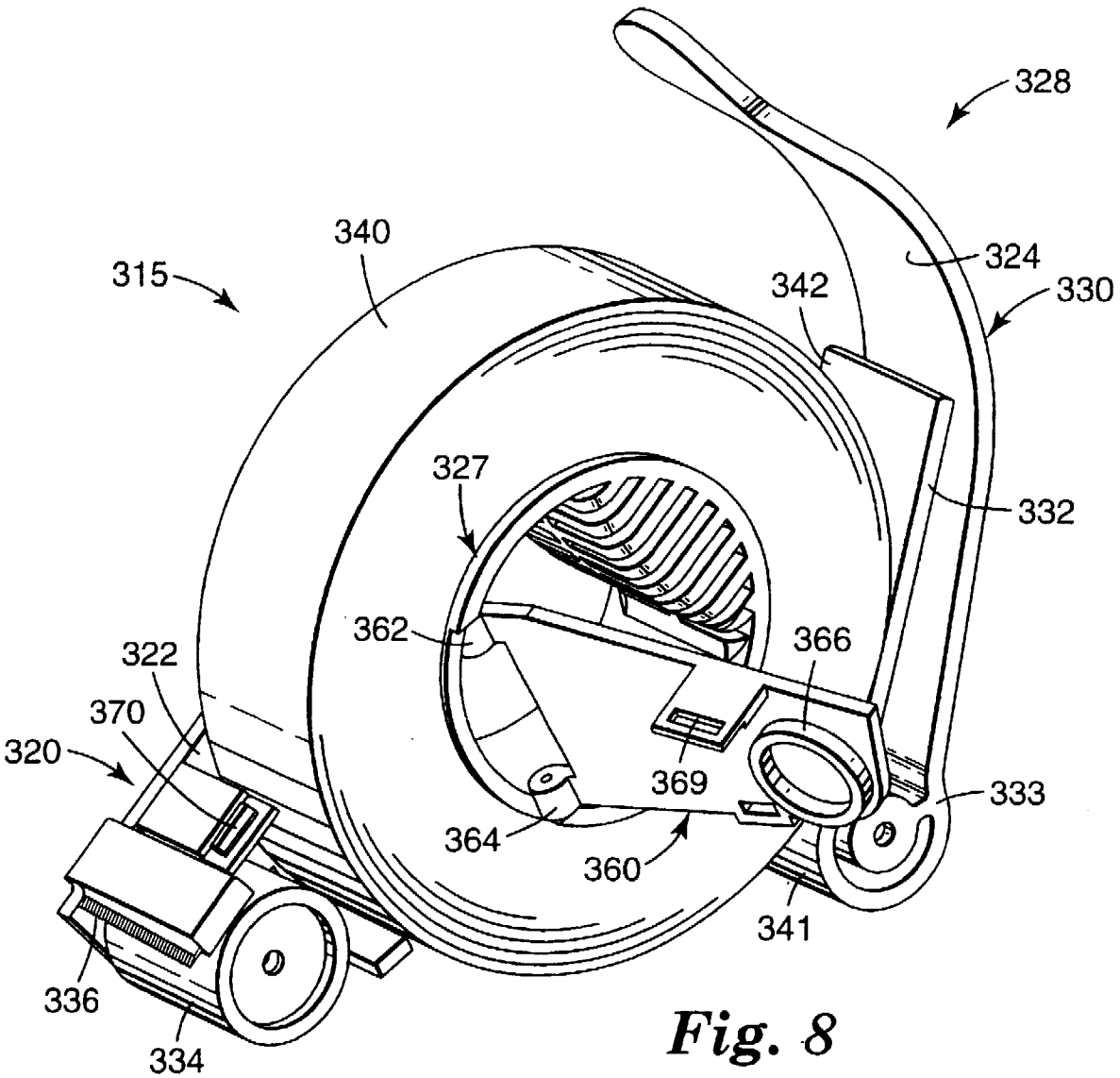
FIG. 8 is an isometric view of an alternative embodiment of the hand-held tape dispensing apparatus of the present invention.
Figure 9:
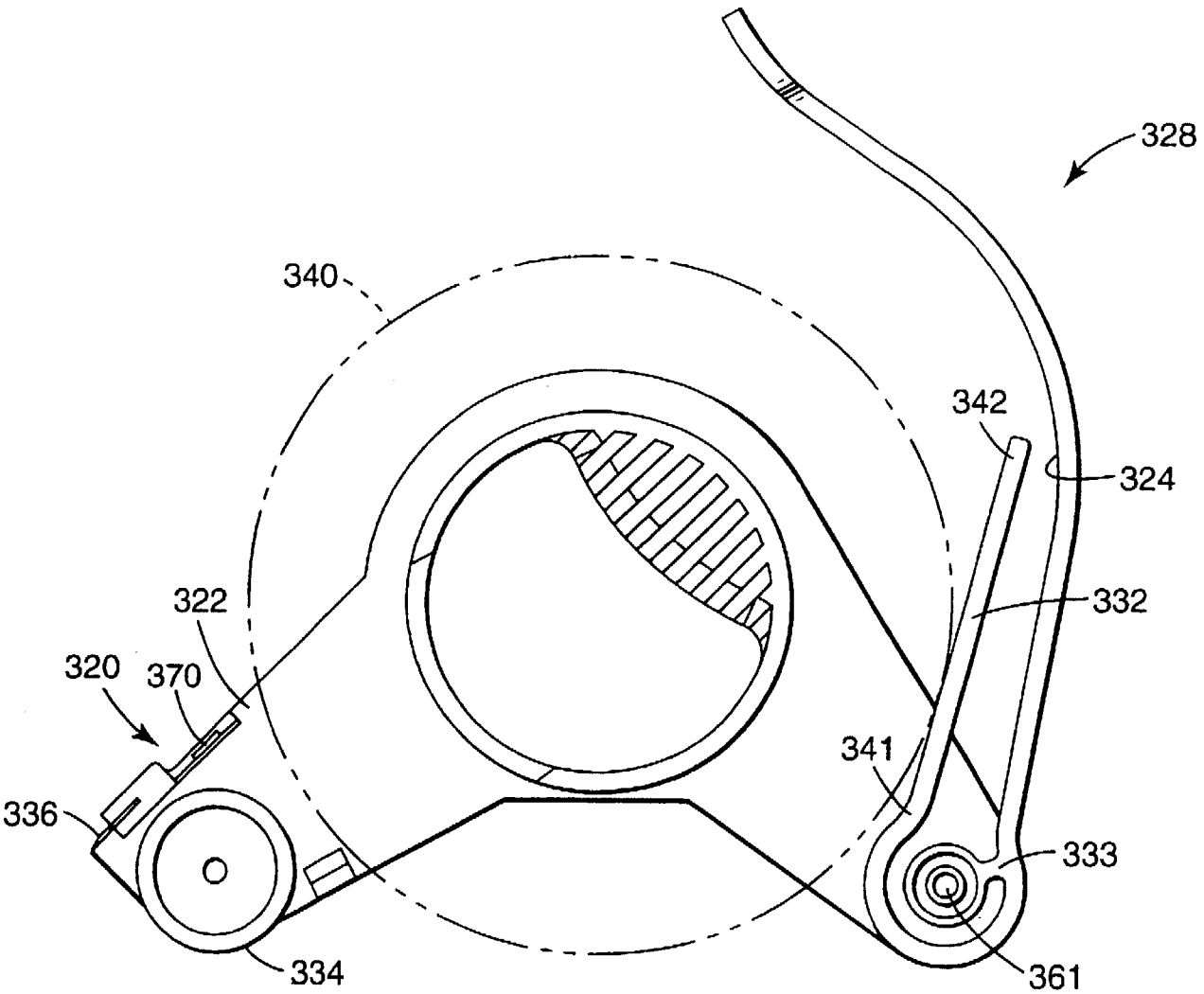
FIG. 9 is a side elevational view of the hand-held tape dispensing apparatus of FIG. 8, with a folding tape cover removed for clarity.

FIGS. 8 and 9 show a second alternative embodiment of the tape dispenser of the present invention. In this embodiment of a dispenser 315, the tape hub 327 is formed as a portion of the frame 320 and is not separable therefrom. Thus, the frame 320 has only one frame member 322 which extends from the brake assembly 328 to the tape cutting knife 336 and tape guide roller 334. The tape guide roller 334 is rotatably mounted relative to the frame 320, and secured thereto by suitable fastening means. The brake assembly 328 is also pivotally mounted relative to the frame 320 by suitable fasteners, along pivot axis 361 (FIG. 9).

As mentioned above, the brake assembly 328 in this embodiment is a unitary member which includes brake actuator 330 and brake plate 332. The brake plate 332 is integrally formed with brake actuator 330, and joined adjacent a junction 333. The brake plate 332 thus pivots with the brake actuator 330 relative to the frame 320 and tape roll 340, but upon moving the brake assembly 328 to its closed position, the brake plate 332 pivots or cantilevers independently to some degree from the brake actuator 330. The brake plate 332 engages the circumference of a tape roll 340 between its first and second ends 341 and 342, and upon further squeezing of the operator's hand, the second end 342 engages an inner surface 324 of the brake actuator 330. Continued pressure results in bending and greater friction pressure force of the brake plate 332 against the outermost wrap of the tape roll 340.

Tape hub 327 is integrally formed with the frame member 322 of the dispenser 315. Its outer circumferential surface 368 is slightly smaller than an inner diameter of the tape roll 340, thus permitting the tape roll 340 to rotate freely thereon. A tape retainer plate 360 is pivotally mounted on the tape hub 327 and sized so that when open (as in FIG. 8), a tape roll 340 can be inserted axially over the tape cover plate 360 and onto the tape hub 327. Once a tape roll 340 is loaded onto the dispenser 315 (as in FIG. 8), the tape cover plate 360 is pivoted to engage the frame 320 and secure the tape roll 340 onto the dispenser 315. At one end, the tape cover plate 360 is pivotally mounted to the tape hub 327, as at pivot points 362 and 364. At its second free end, the tape cover plate 360 has an annular guide 366 for alignment and coupling with the tape guide roller 334. A manually operable latch mechanism includes a slot 369 formed by the tape guide cover 360 and an upstanding tab 370 borne by the frame member 322. When the tape guide cover 360 is pivoted to a closed position (not shown), the tab 370 is received within the slot 369 to retain the tape guide cover 360 in that position and thus retain the tape roll 340 on the frame 320. To remove the tape roll or an empty core thereof from the dispenser 315, the latch mechanism is manipulated to permit pivoting of the tape cover plate 360 to the open position shown in FIG. 8. In FIG. 9, the tape cover plate 360 has been removed for clarity of illustration.

Figure 10:
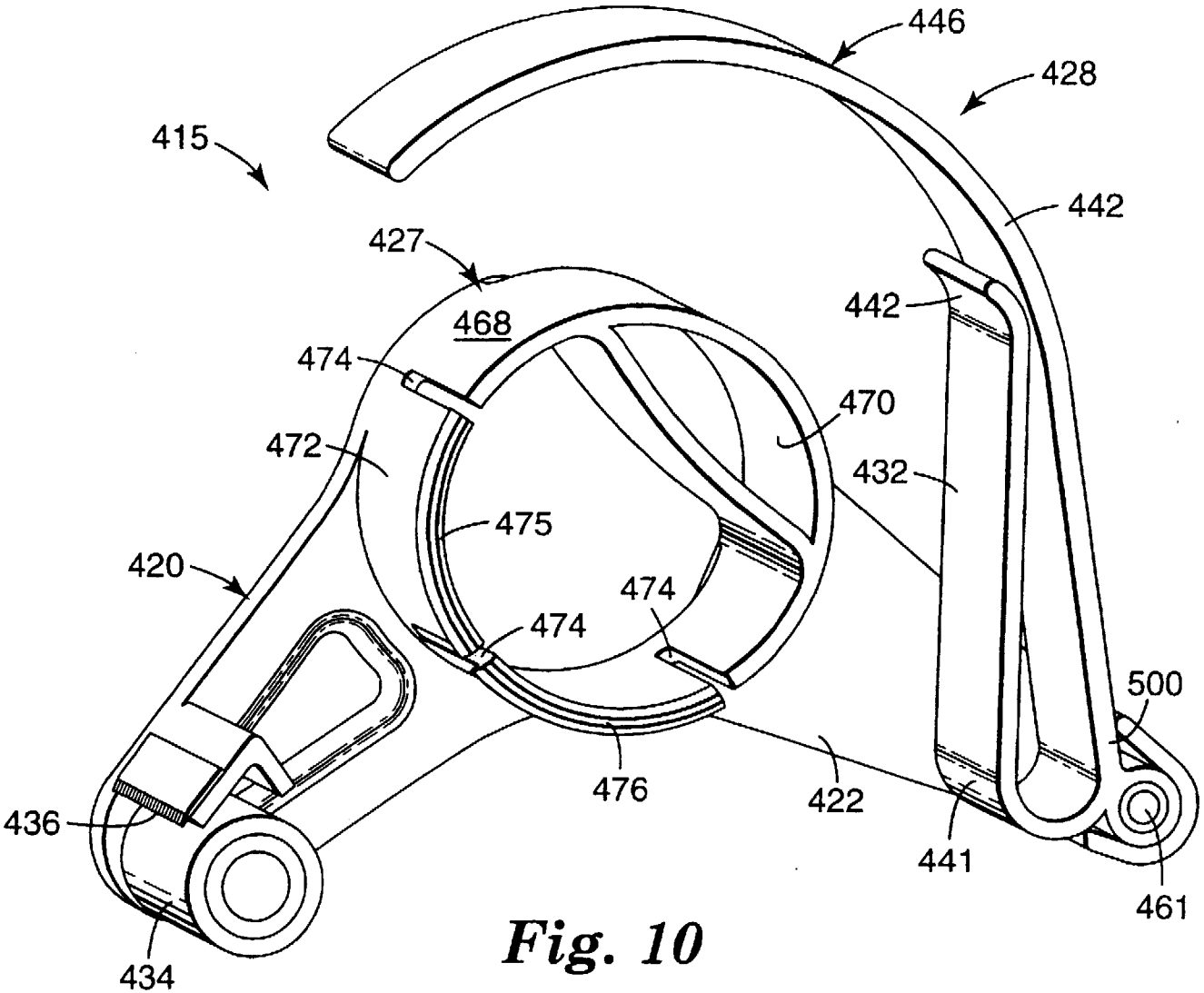
FIG. 10 is an isometric view of an alternative embodiment of the hand-held tape dispensing apparatus of the present invention.

FIG. 10 shows a third alternative embodiment of the tape dispenser of the present invention. Tape dispenser 415 also has its tape hub 427 mounted or formed integrally with its frame 420. The frame 420 has a single frame member 422 which, at one end, has a tape guide roller 434 rotatably mounted thereon, with an adjacent tape cutting knife 436. Adjacent its second end, a brake assembly 428 is pivotally mounted as at pivot axis 461 to the frame member 422. In this embodiment, the brake assembly 428 is again shown as a unitary component formed to include a brake actuator or cover 430 and a brake plate 432. The brake plate 432 has a first end 441 (secured adjacent a first end 500 of the brake actuator 430) and a second free end 442.

Operation of the brake assembly 428 to inhibit or prevent rotation of a tape roll (not shown) mounted on the dispenser 415 is functionally the same as the embodiments described above. Namely, the brake plate 432 engages an outermost wrap of the tape roll and with continued pressure, the engagement becomes greater in surface area and pressure until sufficient to prevent free rotation of the tape roll relative to the tape hub 427.

The tape hub 427 and brake assembly 428 again cooperate to define a handle assembly 446 for the dispenser 415. An outer surface 468 of the tape hub 427 is slightly smaller in diameter than an inner diameter of the tape roll, thus allowing the tape roll to freely rotate about the tape hub 427 (so long as the brake assembly 428 is not applied thereto). The tape roll is held in position on the tape hub 427 by means of a partially extending flange on one or more segments of the free edge of the tape hub 427. The tape hub 427 is segmented in a plurality of segments, such as segments 470, 472 and 473 by laterally extending slots 474 therebetween. The segments, such as segments 472 and 473, bear flanges or shoulders 475 and 476, respectively, which extend beyond the diameter of the outer surface 468. The segments 472 and 473 are sufficiently flexible that insertion of a tape roll thereon will urge the flanges inwardly toward the tape roll axis, but upon complete insertion of the tape roll, the segments 472 and 473 will assume their prior position and the flanges 475 and 476 will extend beyond the inner diameter of the tape roll, thereby securing it to the frame 420. Adjacent their outer circumferential edges, the flanges 475 and 476 are tapered to facilitate insertion of a tape roll. To remove a spent tape roll or core thereof, the flanges are manually urged radially inwardly to create clearance for axial removal of the tape roll or core.

Although the present invention has been described with reference to preferred embodiments, workers skilled in the art will recognize that changes may be made in form and detail without departing from the spirit and scope of the invention.

What is claimed is:

1. A hand-held tape dispensing apparatus comprising:

a frame including a hub for rotatably supporting a roll of tape; and a brake assembly having a brake actuator extending around a portion of the roll of tape, the brake actuator having a first end supported relative to the frame so that a second end thereof is movable towards and away from the roll of tape, and a brake plate disposed between the brake actuator and the roll of tape for frictional engagement with an outermost wrap of the roll of tape upon movement of the second end of the brake actuator toward the roll of tape.

2. The apparatus of claim 1 wherein the hub and brake actuator are formed to define a handle for the tape dispensing apparatus.

3. The apparatus of claim 1 wherein the brake plate has first and second ends, and wherein the brake plate is pivotally supported adjacent its first end relative to the roll of tape and brake actuator for movement therebetween.

4. The apparatus of claim 3 wherein the first end of the brake plate is pivotally supported adjacent the first end of the brake actuator.

5. The apparatus of claim 1 wherein the brake assembly has two operative positions, a first position wherein the brake actuator is spaced from the roll of tape and the brake plate is generally planer and has a first area of contact between the roll of tape and the brake plate, and a second position wherein the brake actuator is urged closer to the roll of tape and at least a portion of the brake plate is bent about the roll of tape and has a second, increased area of contact between the roll of tape and the brake plate.

6. The apparatus of claim 1 wherein the tape has adhesive disposed on at least a portion of at least one side thereof.

7. The apparatus of claim 1 wherein the tape is stretchable and has a leading end portion secured to a workpiece, and wherein the second end of the brake actuator is movable to a position adjacent the roll of tape whereby the brake plate prevents rotation of the roll of tape relative to the frame so that movement of the apparatus away from the workpiece stretches the tape therebetween.

8. The apparatus of claim 1 wherein the brake actuator is pivotally supported on the frame.

9. The apparatus of claim 8 and further comprising pivot stops to limit the extent of pivoting of the brake actuator relative to the frame.

10. The apparatus of claim 1 wherein the hub is separable from the frame.

11. A hand-held tape dispensing apparatus comprising:

a frame including a hub for rotatably supporting a roll of tape; and a brake assembly which includes a brake actuator disposed about a portion of the roll of tape, the brake actuator having a first end pivotally supported on the frame and having a second free end, and a flexible brake plate aligned between the brake actuator and the roll of tape so that movement of the second end of the brake actuator towards the roll of tape urges the brake plate against the roll of tape as a brake to limit rotation of the roll of tape relative to the frame.

12. The apparatus of claim 11 wherein the brake assembly has two operative positions, a first position wherein the brake actuator is spaced from the roll of tape and the brake plate is generally planar and has a first area of contact between the roll of tape and the brake plate, and a second position wherein the brake actuator is urged closer to the roll of tape and at least a portion of the brake plate is bent about the roll of tape and has a second, increased area of contact between the roll of tape and the brake plate.

13. The apparatus of claim 11 wherein the brake plate contacts the roll of tape at approximately the midpoint of the brake plate.

14. The apparatus of claim 11 wherein the brake plate is supported adjacent its ends by the brake actuator, and wherein the brake actuator is arcuate at least between those portions thereof supporting the ends of the brake plate.

15. The apparatus of claim 11 wherein the frame has a tape applicator surface spaced from the hub and roll of tape thereon for engaging the tape as it is dispensed.

16. The apparatus of claim 11 wherein the hub and brake actuator are configured to be manually gripped by an operator.

17. The apparatus of claim 11 wherein the tape has adhesive disposed on at least a portion of at least one side thereof.

18. The apparatus of claim 11 and further comprising pivot stops to limit the extent of pivoting of the brake actuator relative to the frame.

19. The apparatus of claim 11 wherein the hub is separable from the frame.

20. The apparatus of claim 19 wherein the frame and hub have opposed tracks and rails for aligning and supporting the hub relative to the frame.

21. The apparatus of claim 11 wherein the brake plate has first and second ends, with its first end supported by the brake actuator, adjacent the first pivotally supported end of the brake actuator.

* * * * *